US007935902B2

(12) United States Patent
Newase et al.

(10) Patent No.: US 7,935,902 B2
(45) Date of Patent: May 3, 2011

(54) CONTACT ASSEMBLY OF CIRCUIT BREAKER

(75) Inventors: Yatin Vilas Newase, Maharashtra (IN); Janakiraman Narayanan, Andra Pradesh (IN); Pankaj Agrawal, Bangalore (IN); Soundararajan Narayanasamy, Hyderabad (IN); Mahesh Jaywant Rane, Secunderabad (IN)

(73) Assignee: General Electric Company, Schenectady, NY (US)

( * ) Notice: Subject to any disclaimer, the term of this patent is extended or adjusted under 35 U.S.C. 154(b) by 478 days.

(21) Appl. No.: 12/103,116

(22) Filed: Apr. 15, 2008

(65) Prior Publication Data

US 2009/0255792 A1 Oct. 15, 2009

(51) Int. Cl.
*H01H 1/22* (2006.01)

(52) U.S. Cl. ..... 200/244

(58) Field of Classification Search ..... 200/244, 200/248, 275, 243; 218/22, 146, 30–33; 335/16, 147, 195; 439/160
See application file for complete search history.

(56) References Cited

U.S. PATENT DOCUMENTS

| | | | | |
|---|---|---|---|---|
| 5,874,874 | A * | 2/1999 | Helms et al. | 335/16 |
| 6,232,570 | B1 | 5/2001 | Castonguay et al. | |
| 6,479,781 | B1 | 11/2002 | Bagepalli et al. | |
| 6,570,116 | B2 * | 5/2003 | Maulandi et al. | 218/22 |
| 6,917,269 | B2 | 7/2005 | Bach et al. | |
| 7,189,935 | B1 | 3/2007 | Hassan et al. | |
| 7,474,179 | B2 * | 1/2009 | Weister et al. | 335/15 |

* cited by examiner

*Primary Examiner* — Edwin A. Leon
(74) *Attorney, Agent, or Firm* — Global Patent Operation; Stephen G. Midgley

(57) ABSTRACT

A contact arm assembly including a plurality of substantially parallel plates having a space between each of the plurality of substantially parallel plates and a plurality of finger assemblies, at least one of the plurality of finger assemblies being pivotally attached to the plurality of substantially parallel plates and being located in the space between each of the plurality of substantially parallel plates, each of the plurality of finger assemblies having a body and an arc runner, the arc runner being locked against the body in at least two locations.

17 Claims, 8 Drawing Sheets

FIG. 4A
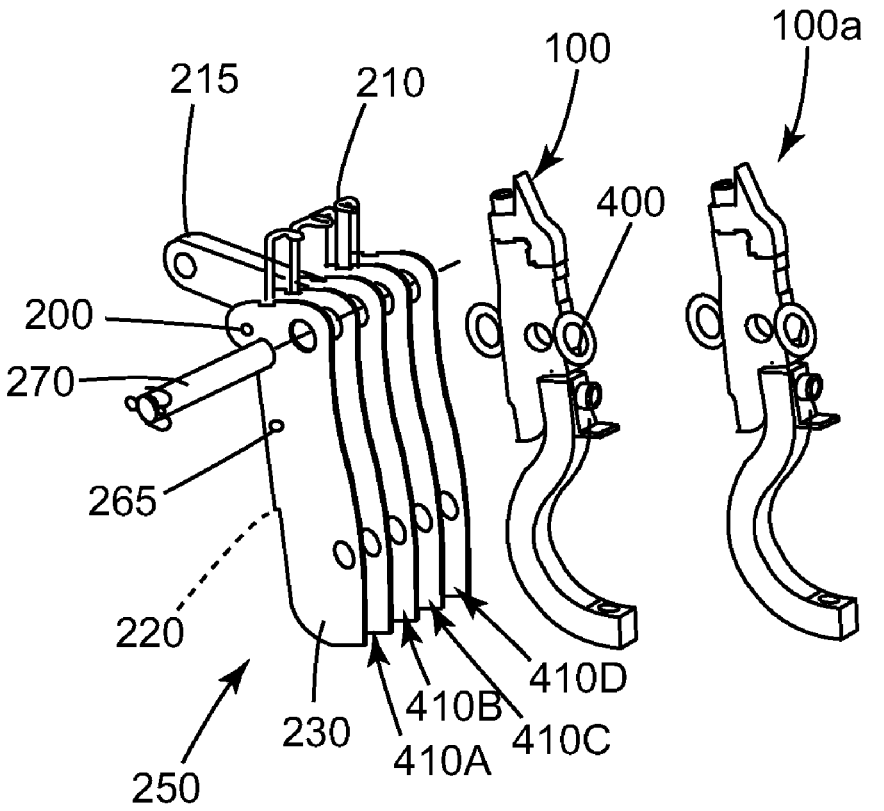
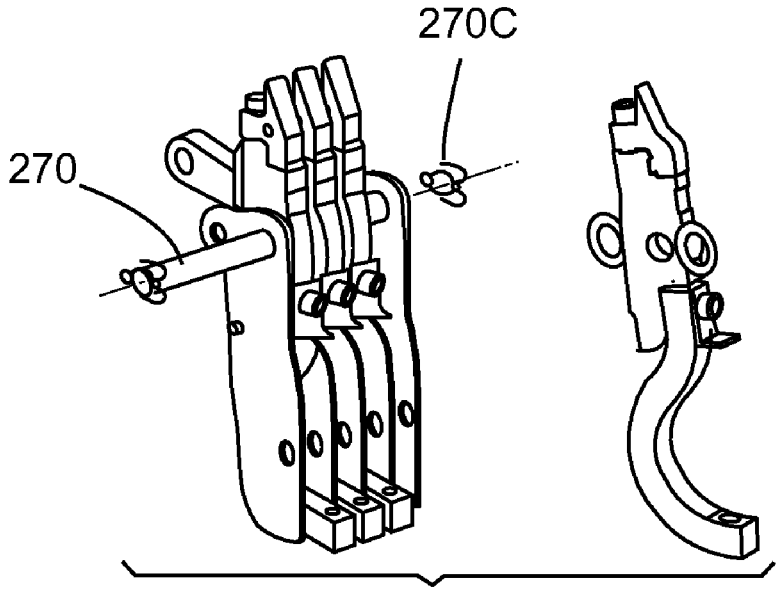
FIG. 4B

CONTACT ASSEMBLY OF CIRCUIT BREAKER

BACKGROUND

The disclosed embodiments relate to contacts that conduct current, and in particular, contacts that experience repulsion forces when mating as a result of the amount of current conducted by the contacts.

Circuit breakers are used to protect equipment from overcurrent situations caused, for example, by short circuits or ground faults in or near such equipment. In the event an overcurrent condition occurs, electrical contacts within the circuit breaker will open, stopping the flow of electrical current through the circuit breaker to the equipment. Circuit breakers may be designed for high quiescent currents and high withstand currents. To maintain a high withstand current rating, the contacts must be locked closed at the current withstand rating and be able to withstand the large electrodynamic repulsion forces generated by the current flow.

The variety of constructions of multipole circuit breakers include blow open and non-blow open contact arms, overcentering and non-overcentering contact arms, single contact pair arrangements with the contact pair at one end of a contact arm and a pivot at the other end thereof, double contact pair arrangements (referred to as rotary breakers) with a contact pair at each end of a contact arm and a contact arm pivot intermediate (typically centrally located between) the two ends, single housing constructions with the circuit breaker components housed within a single case and cover, and cassette type constructions (referred to as cassette breakers) with the current carrying components of each phase housed within a phase cassette and each phase cassette housed within a case and cover that also houses the operating mechanism. Multipole circuit breakers are generally available in two, three, and four pole arrangements, with the two and three pole arrangements being used in two and three phase circuits, respectively. Four pole arrangements are typically employed on three phase circuits having switching neutrals, where the fourth pole operates to open and close the neutral circuit in a coordinated arrangement with the opening and closing of the primary circuit phases.

While conventional circuit breakers are considered suitable for their intended purpose, the art of circuit breakers may be improved by providing a module breaker design having improved operation life and durability while avoiding falling off or movement of the moving runners relative to its respective contact during, for example, short circuit.

BRIEF DESCRIPTION OF THE DISCLOSED EMBODIMENTS

The following are non limiting exemplary embodiments.

In one aspect, a contact arm assembly is provided. The contact arm assembly includes a plurality of substantially parallel plates having a space between each of the plurality of substantially parallel plates and a plurality of finger assemblies, at least one of the plurality of finger assemblies being pivotally attached to the plurality of substantially parallel plates and being located in the space between each of the plurality of substantially parallel plates, each of the plurality of finger assemblies having a body and an arc runner, the arc runner being locked against the body in at least two locations.

In another aspect, a contact arm assembly is provided. The contact arm assembly including a cage bracket having a substantially flat surface and two extensions forming extension plates extending therefrom, the extension plates being substantially parallel to each other, the cage bracket and extension plates substantially forming a U-shape, a plurality of plates located between and substantially parallel to the extension plates, the plurality of plates having a space therebetween and a plurality of finger assemblies, at least one of the plurality of finger assemblies being pivotally attached to the plurality of plates and being located in the space between each of the plates.

In still another aspect, a contact arm assembly is provided a contact arm assembly is provided. The contact arm assembly including a plurality of substantially parallel plates having a space between each of the plurality of substantially parallel plates and a plurality of finger assemblies, at least one of the plurality of finger assemblies being pivotally attached to the plurality of substantially parallel plates and being located in the space between each of the plurality of substantially parallel plates, each of the plurality of finger assemblies having a body and an arc runner, the arc runner of at least one of the plurality of finger assemblies being advanced with respect to arc runners of other different finger assemblies of the plurality of finger assemblies.

BRIEF DESCRIPTION OF THE DRAWINGS

The foregoing aspects and other features of the presently disclosed embodiments are explained in the following description, taken in connection with the accompanying drawings, wherein:

FIGS. 4A-4D illustrate an exemplary method for assembling a circuit breaker finger assembly in accordance with an exemplary embodiment.

DETAILED DESCRIPTION

Figures 1A, 1B, 1C, 1D, 1E, 1F:
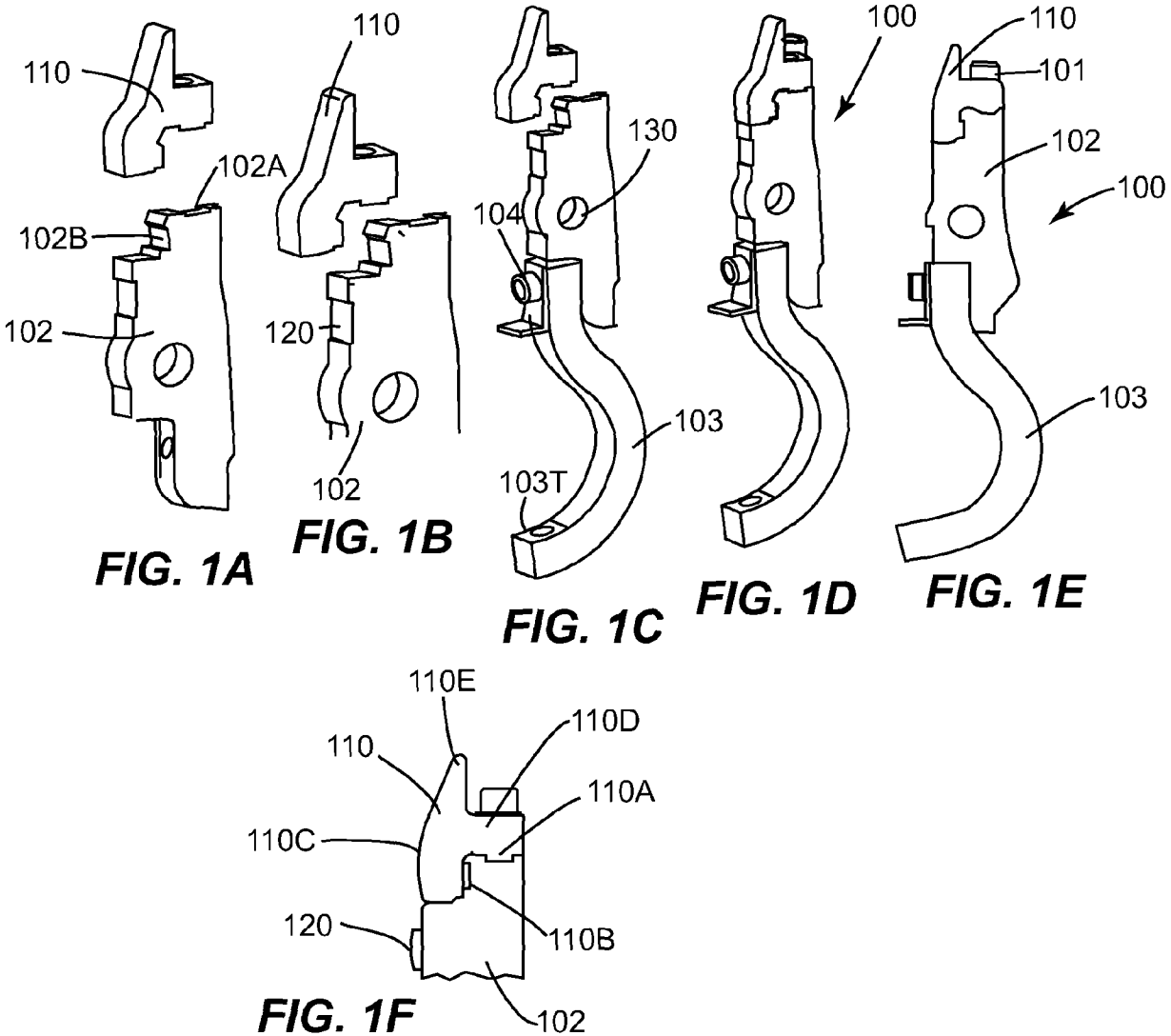
FIGS. 1A-1F shows various perspective and side views of an exemplary finger of a circuit breaker in accordance with the exemplary embodiments.
Figure 2A:
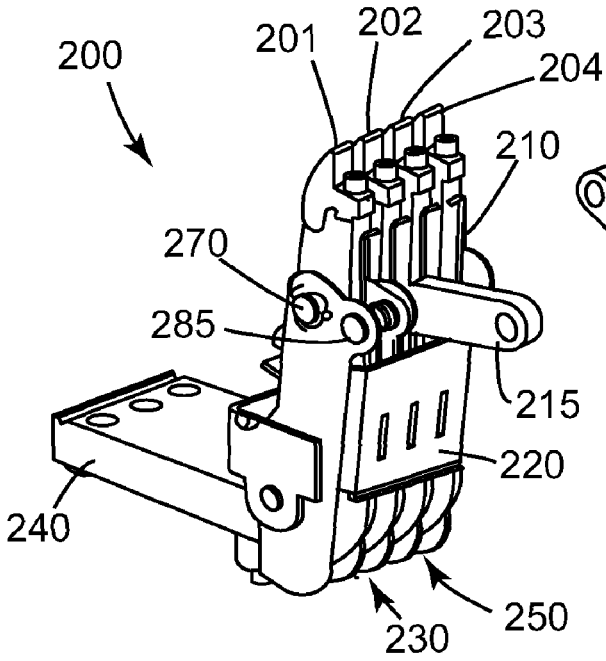
FIGS. 2A and 2B show an exemplary circuit breaker finger assembly in accordance with the exemplary embodiments.
Figure 2B:
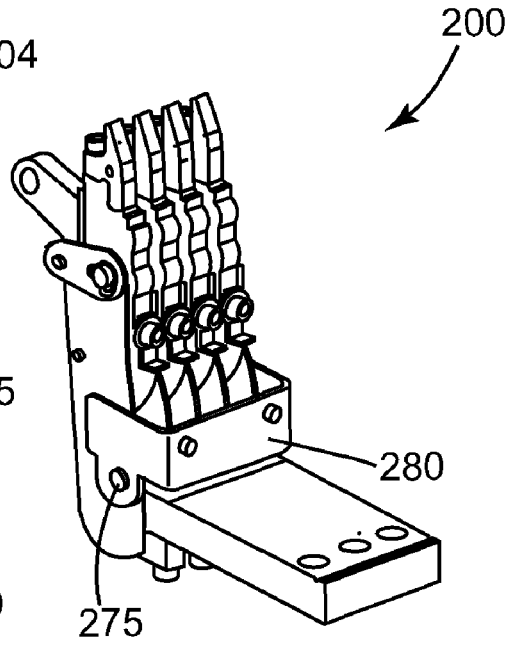
Figure 3A:
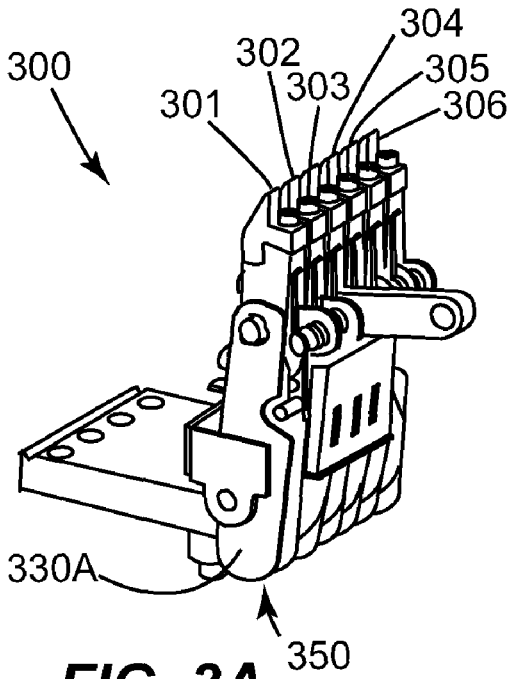
FIGS. 3A and 3B shows another exemplary circuit breaker finger assembly.
Figure 3B:
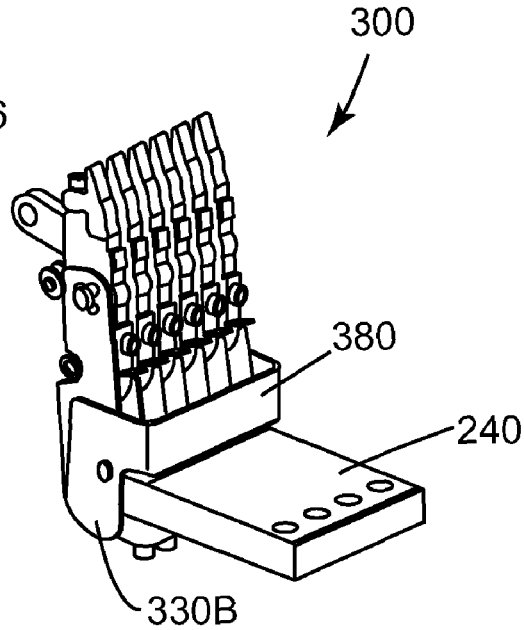
Figure 2C:
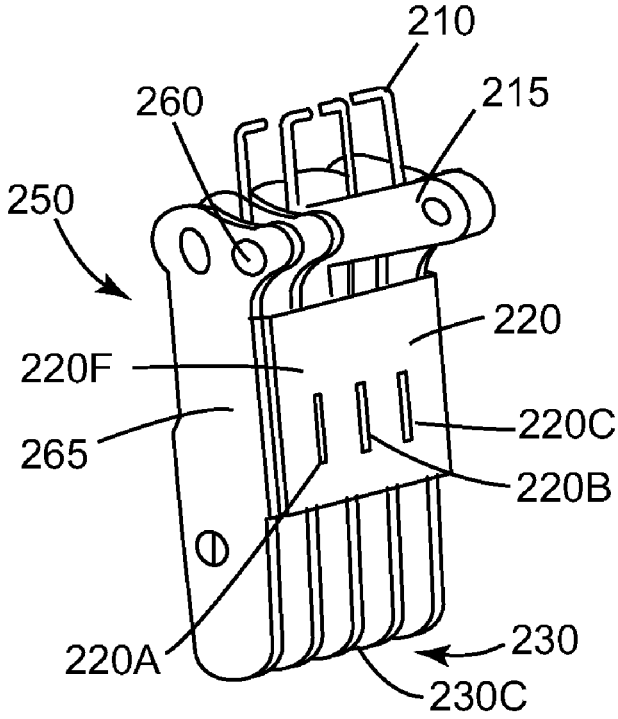
FIGS. 2C and 2D shows an exemplary circuit breaker cage assembly in accordance with aspects of the exemplary embodiments of FIGS. 2A and 2B.
Figure 2D:
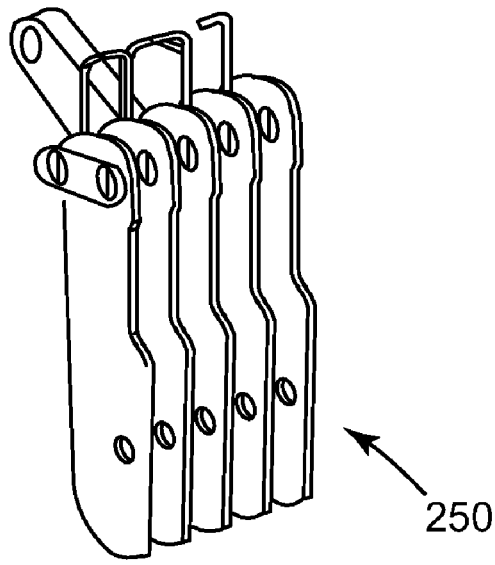
Figure 3C:
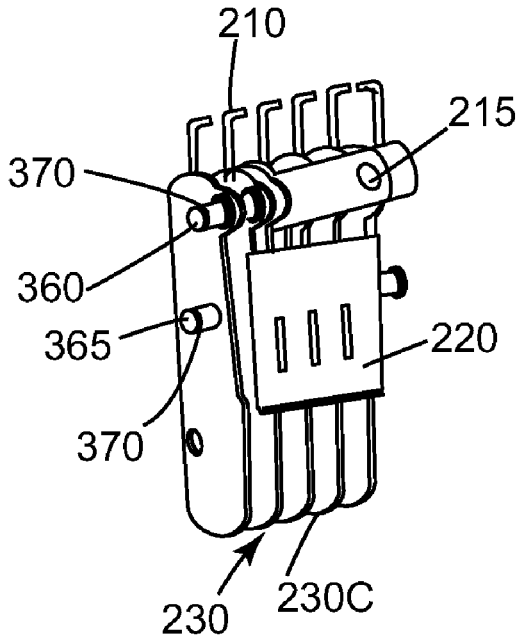
FIGS. 3C and 3D shows an exemplary circuit breaker cage assembly in accordance with aspects of the exemplary embodiments shown in FIGS. 3A and 3B.
Figure 3D:
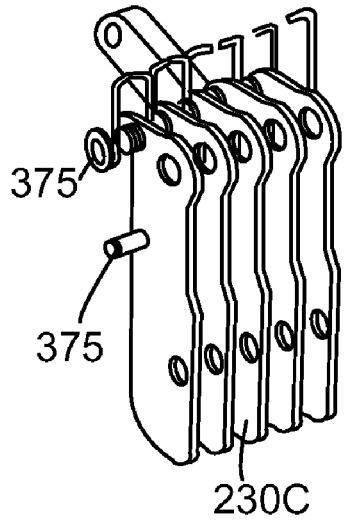
Figure 2E:
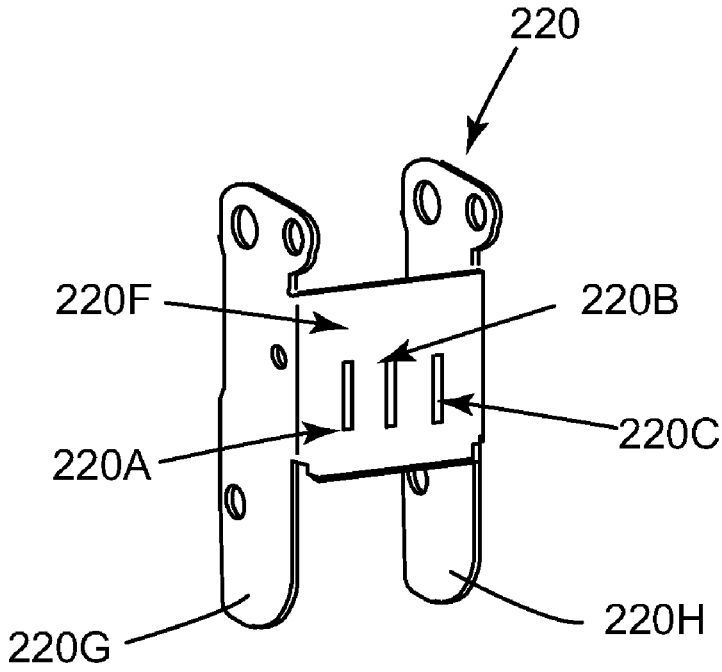
FIGS. 2E and 2F illustrate exemplary components of the circuit breaker cage assembly in accordance with aspects of the exemplary embodiments of FIGS. 2A and 2B.
Figure 2F:
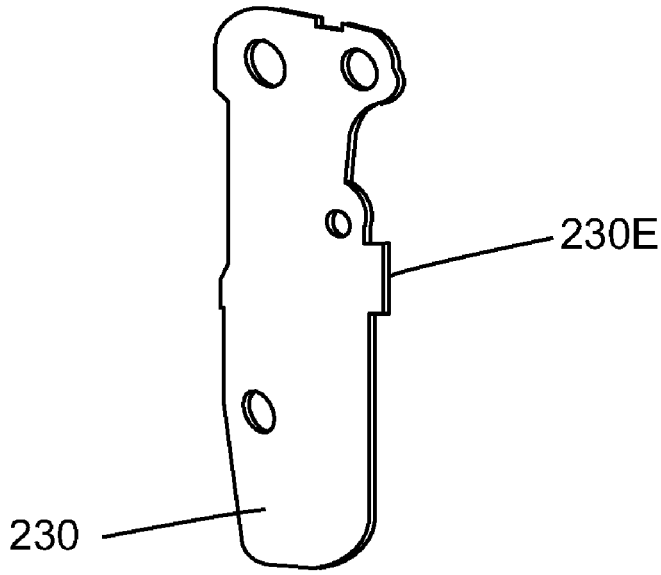

FIGS. 1A-1F show an exemplary finger assembly 100 for a circuit breaker suitable for practicing the embodiments disclosed herein. Examples of suitable circuit breaker include but are not limited to air circuit breakers. Although the presently disclosed embodiments will be described with reference to the drawings, it should be understood that they may be embodied in many alternate forms. It should also be understood that in addition, any suitable size, shape or type of elements or materials may be used.

The exemplary embodiments provide for increased operational life of the circuit breaker during, for example normal operation, while avoiding the falling off of the moving runners during a short circuit.

In one aspect the exemplary embodiments provide an improved coupling between the moving arc runners and the finger body. In another aspect, the exemplary embodiments provide a rigid and robust contact moving arrangement which can withstand and account for large electrodynamic repulsion forces created by, for example, current flowing in the circuit breaker.

Referring now to FIGS. 1A-1F, an exemplary finger assembly 100 of a circuit breaker incorporating aspects of the disclosed embodiments will be described. The finger assembly 100 includes a body 102, flexible conducting member 103, a primary contact 120 and an arc runner 110. In alternate embodiments the finger may include any suitable components having any suitable relationship with each other. As can be seen in the Figures, the body 102 includes a mounting hole 130 for mounting the finger assembly 100 in a cage assembly as will be described in greater detail below. In this example, the flexible conducting member 103 may be coupled to a first end of the body 102 in any suitable manner. Here, for exemplary purposes only, the flexible conducting member 103 fits into a notch or recessed area of the body and is removably affixed to the body by, for example, a screw 104. In alternate embodiments the flexible conducting member 103 may be affixed to the body 102 in any suitable manner including, but not limited to, welding, brazing or any other suitable mechanical and/or chemical fasteners. In still other alternate embodiments the flexible conducting member 103 and the body 102 may be integral with each other (e.g. have a unitary or one piece construction). The flexible conducting member 103 may also provide a terminal connection location 103T for connecting the finger 100 to a pole of the electrical circuit. In one embodiment the flexible conducting member 103 may be resilient to allow pivoting of the contact assembly 200 about, for example, moving arm pin 275 when the fingers 201-204 are coupled to the load terminal 240 (see FIGS. 2A-2D). The flexible conducting member 103 may also provide a spring force to assist in opening the circuit contacts with a desired velocity upon a short circuit event.

An arc runner 110 is suitably coupled to a second end of the body 102. The arc runner 110 may have any suitable shape and configuration for minimizing arcing between the arc runner 110 and its corresponding electrical contact 590 of load terminal 590 (see FIG. 5). For example, the arc runner may have a rounded or arcuate contact face 110C having a portion 110E that extends, for example, axially away from the body. The shape of the arc runner may be a complex shape configured to direct any arcing away from the contact and towards, for example, a screen or plate (not shown) located adjacent the finger assemblies so that any deterioration caused by the arcing is directed towards the screen or plate. The arc runner 110 may have a base 110D for coupling the arc runner to the body 102. In this example the base is shown as having a L-shape but in alternate embodiments the base may have any suitable shape. The base 110D may extend away from the contact face 110C and include at least a first and second locking feature 110A, 110B. While only two locking features are shown in the example, in alternate embodiments the arc runner may have any suitable number of locking features, such as more than two locking features. In this example, the locking features 110A, 110B are protrusions extending from the base 110D and have substantially orthogonal spatial relationship with respect to each other so that the locking features 110A, 110B extend from the base toward a common point or substantially in the same direction. In alternate embodiments the locking features may extend away from each other in, for example, substantially opposite directions. In still other alternate embodiments the locking features may have any suitable spatial relationship with each other. In this example the locking features are shown as having a rectangular profile but in alternate embodiments the locking features may have any suitable shape including, but not limited to, a dovetail shape, a rounded or arcuate shape, a triangular shape or any other suitable shape or combination of shapes. The locking features 110A, 110B are received in corresponding recesses 102A, 102B respectively in the body 102 such that the interface between the locking features 110A, 110B and the recesses 102A, 102B substantially prevents or minimizes movement of the arc runner 110 relative to the body 102. Minimizing movement of the arc runner 110 relative the body may decrease wear on the arc runner by reducing arcing between and/or directing arcing away from the arc runner 110 and its corresponding contact 590. In one example, during mechanical endurance of the circuit breaker, the mounting screw 101 may have a tendency of loosening and backing. In other examples, during endurance the arc runner 110 may have a tendency to rotate about the axis of screw 110. The locking features 102B, 102A and 110A and 110B are configured to provide locking/anti-turn prevention for the arc runner to minimize loosening and movement of the arc runner. As can be seen in the Figures the arc runner 110 may be removably affixed to the body 102 by a screw but in alternate embodiments the arc runner 110 may be affixed to the body 102 in any suitable manner including, but not limited to, welding, brazing or any other suitable mechanical and/or chemical fasteners. In still other alternate embodiments the arc runner 110 and the body 102 may be integral with each other (e.g. have a unitary or one piece construction).

A primary contact 120 may also be affixed to the body 102 in any suitable manner including, but not limited to, any suitable mechanical and/or chemical fasteners as described above with respect to the flexible conducting member 103 and arc runner 110. The primary contact 120 may provide for a primary current passage through the circuit breaker after the flow of current is initialized by and through the arc runner 110.

Referring now to FIGS. 2A-2F, an exemplary contact arm assembly 200 is shown. The contact arm assembly includes at least one finger and is shown in the Figures as having four fingers or finger assemblies 201-204 for exemplary purposes only. Each of the finger assemblies together corresponds to a separate pole of an electric circuit. In other embodiments the contact arm assembly may have more or less than four fingers. Each of the fingers 201-204 may be substantially similar to finger 100 described above. In this example the contact arm assembly 200 includes a cage assembly 250, and one or more fingers 201-204. In alternate embodiments the contact arm assembly may have any suitable components. The cage assembly 250 includes a plurality of substantially parallel plates 230 each spaced from each other so that a finger 201-204 can be located between respective plates 230. The spacing between the plates may provide suitable operational clearance so that the fingers 201-204 can rotate or pivot freely between the plates 230. Each of the plates may be substantially similar to each other and have a generally "L-shaped" configuration. In alternate embodiments the plates may have any suitable configuration including, but not limited to, rectangular, T-shaped and arcuate configurations. Each of the plates may include apertures or holes for receiving support pins as described below. In one example, the parallel plates 230 and the bracket 220 (described below) may have a non-magnetic material. In alternate embodiments any one or more of the plate and/or cage bracket may be constructed of a magnetic material and/or ferromagnetic material, or may be formed by stacking CRGO (cold rolled grain orientation steel laminations) together thus helping for proximity effect causing uniform current flow in all of the fingers. The plates may provide a modular assembly where plates can be added to or taken away from the assembly depending on the number of fingers that are to be included in the contact arm assembly.

The plates 230 may be affixed to a cage bracket 220 by pin 265. The cage bracket 220 may have any suitable configuration to provide support for the plates and to provide the spacing between the plates. The cage bracket 220 may also be configured to at least partially enclose the spaces between the plates 230 for housing the fingers between the plates. In one exemplary embodiment, the cage bracket includes a substantially flat surface 220F having extension plates 220G, 220H extending therefrom. The extension plates 220G, 220H may be substantially similar to plates 230, however the extension plates may have a unitary or one-piece construction with the flat surface 220F. In alternate embodiments the extension plates 220G, 220H may be affixed to the flat surface 220F in any suitable manner. In one embodiment the cage bracket flat surface 220F may have slots 220A-200C that interface with corresponding bosses or extensions 230E that extend from the plates 230 to provide structural rigidity for the plates. The interface between the slots 220A-220C and the bosses 230E may keep the plates in their substantially parallel condition. The cage bracket 220 and parallel plates 230 have corresponding holes to receive pins 265 and 260 thus enabling the parallel plates 230 fixing to cage bracket 220. The substantially flat surface 220F of the bracket 220 may abut against the plates 230 so that the plates 230 do not rotate relative to the bracket 220. As can be seen from the Figures the bracket 220 may provide structural support for the cage assembly 200 and its components. For example, the cage bracket is configured as a rigid support member for maximizing the rigidity of the arm assembly and provides (along with the center plate 230C and moving arm formed by the plates and pins) rigidity to the contact arm assembly for withstanding large electrodynamic repulsion forces seen during a short circuit ICW, endurance (High current withstand or Instantaneous current Withstand & mechanical endurance). The support bracket 280 may also be configured to interface with the fingers 201-204 so that the fingers 201-204 move in unison with each other (e.g. as a unit) so that the contacts corresponding to each pole of the circuit breaker are either opened or closed substantially simultaneously.

One or more springs 210 are also attached to the plates 230 by pin 260. The springs can be installed in the cage assembly by inserting the springs into the spaces between the plates 230 and sliding the pin 260 through the springs. In alternate embodiments the springs can be installed in the cage assembly in any suitable manner. In this example, the springs are torsion springs but in alternate embodiments any suitable springs may be used including, but not limited to, leaf springs and compression springs. As can be seen best in FIG. 2A, there is a spring for each of the fingers 201-204. In alternate embodiments, there may be one spring for all of the fingers or one spring may interface with any suitable number of fingers. In this example, a first end of the spring interfaces with a respective one of the fingers 201-204 and a second end of the spring is fixed within the cage assembly 250 by for example the pin 265 and or cage bracket 220. The springs 210 may be configured and have sufficient spring force to hold the contacts of the circuit breaker together in a normal operating condition as well as after erosion of the contacts in case of a short circuit. A pole coupler may also be coupled to the cage assembly by pin 260 for effecting rotation of the cage assembly about moving arm pin 275 when, for example, a switch of the circuit breaker is actuated to either open or close the circuit breaker. The pole coupler may transfer rotational motion and force of a lay shaft (of e.g. the switch or switch assembly/mechanism) to the contact arm assembly 200. The pole coupler may also provide electrical isolation between the switch and the contact arm assembly 200.

As noted above the fingers 201-204 are inserted between the plates 201-204 of the cage assembly 250 and are pivotally held in place by pin 270. It is noted that the pin 270 may also serve to act as a pivot for the cage assembly 200. Pin 265 may serve as a stop for the fingers 201-204 to prevent undesired rotation of the fingers 201-204. A support bracket 280 is mounted to the cage assembly 250 and is configured to provide support for the cage assembly 250 and the finger assemblies 100. Coupling of the cage assembly 250 and the finger assemblies 100 through the support bracket may also improve the rigidity of the contact arm assembly. The support bracket 280 may also effect the mounting of the load terminals 240 to a respective one or more of the finger assemblies (at for example, location 103T of the finger assemblies) and/or the contact arm assembly 200. The support bracket may also provide a coupling between the contact arm assembly 200 and a housing of the circuit breaker.

Referring now to FIGS. 3A-3D another exemplary contact arm assembly 300 is shown. In this example, the contact arm assembly 300 may be substantially similar to contact arm assembly 200 unless otherwise noted. Thus, similar features are designated with similar reference numbers. In this example, the contact arm assembly 300 includes six fingers 301-306 for exemplary purposes only and in other embodiments the contact arm assembly may have more or less than six fingers. The fingers 301-306 may be substantially similar to finger 100 described above. As can be seen best in FIGS. 3C and 3D the pins 360 and 365 extend past the cage bracket 220 so that the fingers 301-306 and their respective springs 210 are cantilevered off of the cage bracket 220. As can also be seen in the Figure, one end of the springs 210 abuts the pin 265 to allow for the torsional action of the spring so that force is exerted on a respective one of the fingers 301-306. The ends of the pins 360, 365 may include recesses 370 for interacting with, for example, a stop washer 375. End plates 330A, 330B may be placed over the pins 360, 365 and abut the stop washers 375 so that sufficient clearance is provided to allow for the free rotation of a respective one of the fingers 301, 306. It is noted that the end plates 330A, 330B are shown as having a different shape than plates 230 but in alternate embodiments the end plates may have any suitable shape including, but not limited to, the shape of the plates 230. End plates 330A, 330B comprises of magnetic material lamination sheets which covers the flexible conducting members 103 from sides. This magnetic material provides easy magnetic path to magnetic field produced by current in set of one pole conductors and reduces the proximity effect of currents within each fingers & as well as due to adjacent poles. Due to reduction in proximity the current distribution is more uniform within fingers of same pole. The support bracket 380 may be substantially similar to bracket 280 however, the support bracket 380 may be extended to accommodate the greater number of fingers, which in this example is six. However, in alternate embodiments the support bracket may be increased or decreased in length depending on the number of fingers and/or plates as determined by the modular plate cage assembly as described above.

Figure 4C:
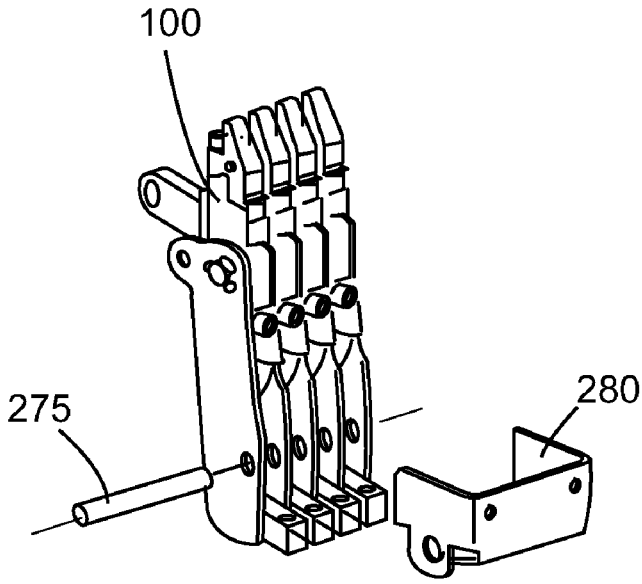
Figure 4D:
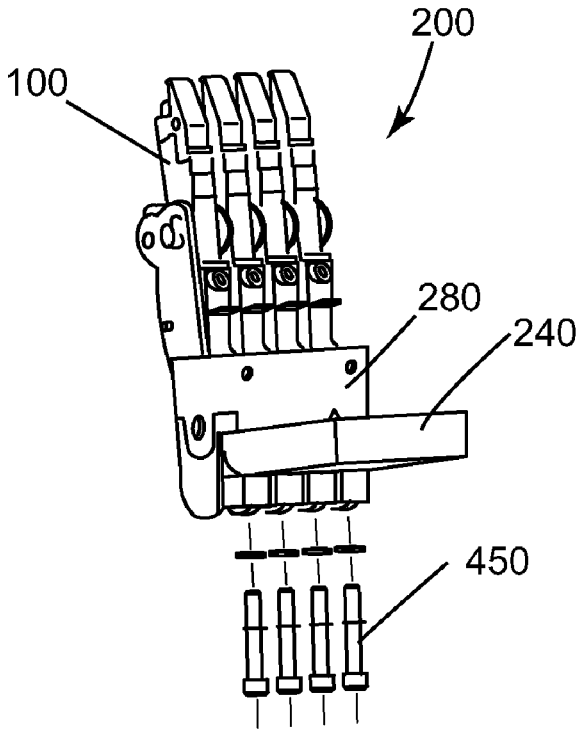

Referring now to FIGS. 4A-4D an exemplary assembly sequence will be described for assembling contact assemblies described herein. As shown in FIG. 4A the cage assembly 250 is assembled by, for example, sliding the plates 230, springs 210, pole coupler 215 and cage bracket 220 over pins 260, 265. Suitable clips or other retaining device may be provided on the ends of pins 260, 265 to hold the plates 230, springs 210, pole coupler 215 and cage bracket 220 together. As can be seen in FIG. 4A, a finger assembly 100 may be inserted into each of the spaces 410A-410C formed between the plates 230. Suitable bearing devices including, but not limited to, washers 400 may be provided on either side of each finger assembly 100 to space the finger assembly 100 apart from adjacent plates 230. It is noted that the washers may be any suitable washers constructed of any suitable material including but not limited to magnetic, ferromagnetic and insulating materials. As shown in FIG. 4B, as each finger assembly is inserted into the cage assembly pin 270 may be sequentially slid through holes 130 of the inserted finger assemblies 100. Upon insertion of all the finger assemblies 100 the last plate 230L may be fitted over the pins 260, 265, 270 and the pin 270 may be retained on either side of the plates 230 by any suitable retaining device such as cotter pin 270C. In alternate embodiments the retaining device may be any suitable device including, but not limited to, C-clips, welding or any other suitable mechanical or chemical fasteners. It is noted that the pin 270 may cause the contacts (e.g. primary contact 120 or arc runner 110) of the finger assemblies 100 to contact a respective load terminal substantially at the same time. As can be seen best in FIG. 4C, the support bracket 280 is placed over and around the cage bracket 220 and is held in place by pin 275. The load terminals 240 may be coupled to the locations 103T on the fingers 100 and to the support bracket 280 by, for example, screws 450 as can be seen in FIG. 4D. In alternate embodiments the load terminals may be coupled to the fingers 100 and/or the support bracket 280 in any suitable manner. As can be seen in FIG. 4D the pivotal coupling of the support bracket 280 allows the contact arm assembly 200 to rotate about pin 275 as force is applied to the contact arm assembly by pole coupler 215. It is noted that the assembly of contact arm assembly 300 may be performed in a manner substantially similar to that described above.

The plate configuration of the contact assemblies 200, 300 may provide a modular contact arm assembly that allows for any suitable number of finger assemblies in a circuit breaker such, as for example, an air circuit breaker. Plates can be added or removed from the assembly depending on a desired number of poles for which the circuit breaker is to be applied. The modular contact arm assembly also provides for maximized rigidity to withstand, for example, the large electrodynamic forces exerted on the contact arm assembly during a short circuit event.

Figure 5A:
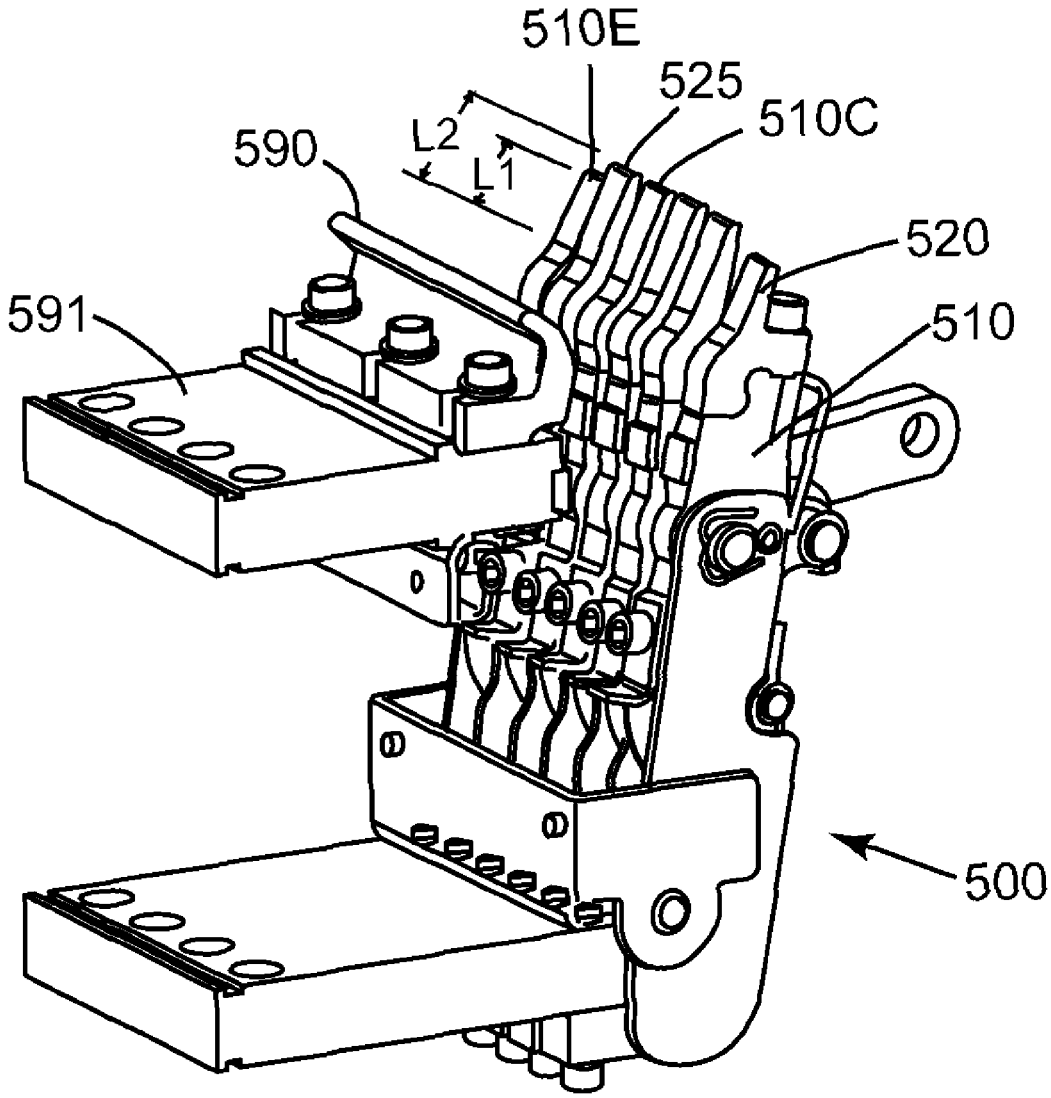
FIGS. 5A and 5B show partial assemblies of a circuit breaker including aspects of the exemplary embodiments.
Figure 5B:
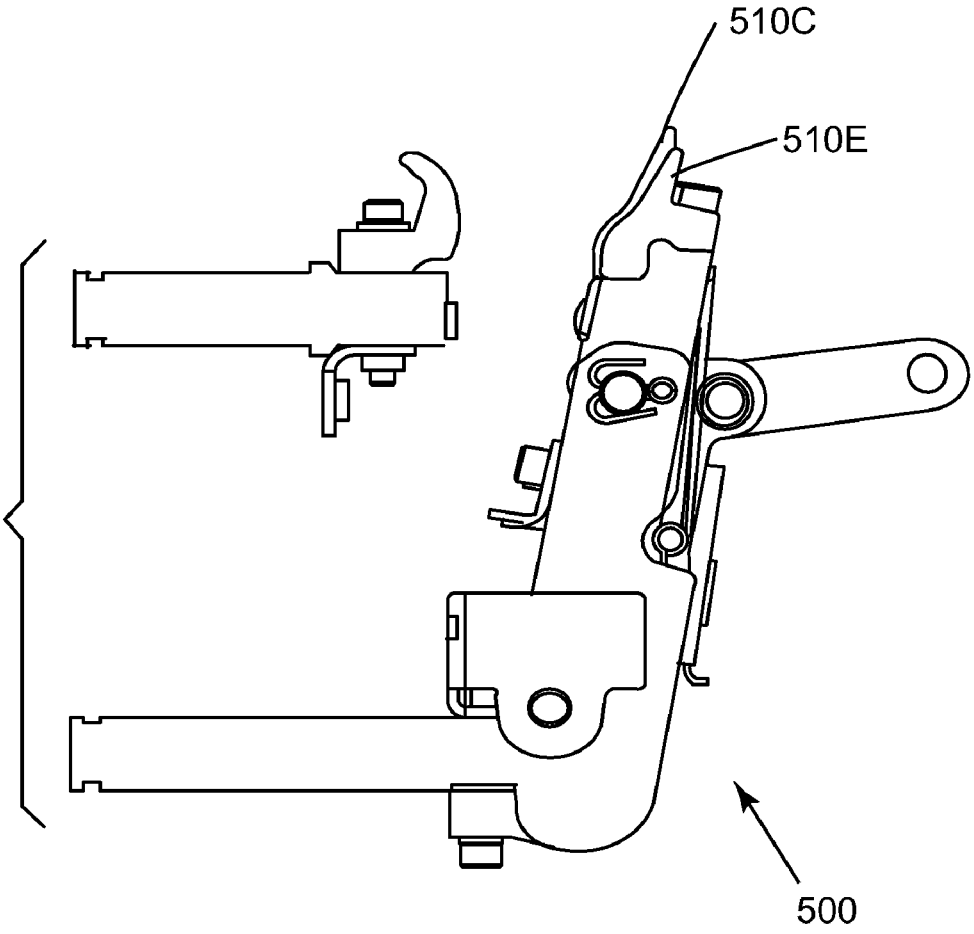

Referring now to FIGS. 5A and 5B, one or more of the finger assemblies may be modified to provide additional improvements to the electrical endurance performance of the circuit breaker. For example, in one exemplary embodiment one or more of the arc runners of the finger assemblies can be extended when compared to other arc runners of the contact arm assembly. In this example, the arc runners 525 of the four center finger assemblies 510C have a greater length L2 than the length L1 of the arc runners for the two end finger assemblies 510E. One or more of the finger assemblies may also be advanced or are placed in such a way that they are ahead of or forward compared to other finger assemblies. For example, in this embodiment as can be seen in FIGS. 5A and 5B, the four middle finger assemblies 510C may be advanced in relation with the two end finger assemblies 510E so that, for example the middle fingers make electrical contact first and break last when the circuit breaker is opened or closed. In alternate embodiments, the middle two finger assemblies) or any other suitable number of finger assemblies) may be advanced with respect to the other finger assemblies. In still other alternate embodiments the end fingers may be advanced with respect to the middle fingers. Contact of the advanced finger assemblies may center the arc formed when opening and/or closing the circuit breaker to improve or maximize the electrical endurance of the circuit breaker.

It is noted that the exemplary embodiments can be used individually or in any suitable combination thereof. It is also noted that this written description uses examples to disclose aspects of the invention, including the best mode, and also to enable any person skilled in the art to practice the aspects of the invention, including making and using any devices or systems and performing any incorporated methods. The patentable scope of the aspects of the invention is defined in the claims, and may include other examples that occur to those skilled in the art. Such other examples are intended to be within the scope of the claims.

What is claimed is:

1. A contact arm assembly comprising:

a plurality of substantially parallel plates having a space between each of the plurality of substantially parallel plates; and a plurality of finger assemblies, at least one of the plurality of finger assemblies being pivotally attached to the plurality of substantially parallel plates and being located in the space between each of the plurality of substantially parallel plates, each of the plurality of finger assemblies having a body and an arc runner the arc runner being locked against the body in at least two locations;

a bracket having a flat surface with slots at predetermined intervals, each of the substantially parallel plates having at least one extension configured to interface with corresponding ones of the slots such that the flat surface is substantially perpendicular to the plurality of substantially parallel plates, the bracket being configured to partially enclose the space between the substantially parallel plates for housing at least one of the plurality of finger assemblies.

2. The contact arm assembly of claim 1, wherein the arc runner of at least one of the plurality of finger assemblies has a different length than the arc runners of other ones of the plurality of finger assemblies.

3. The contact arm assembly of claim 1, wherein the body of each of the plurality of finger assemblies includes at least two spaced recesses for engaging corresponding spaced protrusions of a respective arc runner.

4. The contact arm assembly of claim 3, wherein the at least two recesses and corresponding protrusions are configured to minimize movement of the respective arc runner relative to the body.

5. The contact arm assembly of claim 1, wherein the contact arm assembly is a modular contact arm assembly where the number of substantially parallel plates and the spaces formed between the substantially parallel plates can be added or reduced depending on a predetermined number of finger assemblies.

6. The contact arm assembly of claim 1, further comprising a rotatable support bracket rotatably coupled to the plurality of substantially parallel plates and connected to the plurality of finger assemblies, the support bracket being configured to couple the contact arm assembly to a circuit breaker housing.

7. The contact arm assembly of claim 1, further comprising:

a spring support passing through the plurality of substantially parallel plates;

a plurality of springs mounted to the spring support, each space having a spring for exerting a force on a respective one of the plurality of finger assemblies; and a pole connector pivotally mounted to the spring support for transferring rotational motion to the contact arm assembly.

8. The contact arm assembly of claim 1, wherein at least one of the plurality of substantially parallel plates comprises a ferromagnetic material or magnetic material lamination sheets.

9. A contact arm assembly comprising:

a cage bracket having a substantially flat surface and two extensions forming extension plates extending therefrom, the extension plates being substantially parallel to each other, the cage bracket and extension plates substantially forming a U-shape;

a plurality of plates located between and substantially parallel to the extension plates, the plurality of plates having a space therebetween; and a plurality of finger assemblies, at least one of the plurality of finger assemblies being pivotally attached to the plurality of plates and being located in the space between each of the plates wherein:

each of the plurality of finger assemblies includes a body and an arc runner, the arc runner interface surface includes at least two orthogonally spaced apart recesses; and the body interface surface includes at least two orthogonally spaced apart protrusions corresponding to the at least two orthogonally spaced apart recesses, the at least two orthogonally spaced apart protrusions being configured to engage the at least two orthogonally spaced apart recesses for minimizing relative movement between the body and arc runner.

10. The contact arm assembly of claim 9, further comprising an end plate coupled on either side of the cage bracket, the end plates being spaced apart from and substantially parallel to the extension plates, wherein a finger assembly is located in a space between each of the end plates and the cage bracket.

11. The contact arm assembly of claim 10, wherein the end plates comprise a ferromagnetic material or magnetic material lamination sheets.

12. A contact arm assembly comprising:

a plurality of substantially parallel plates having a space between each of the plurality of substantially parallel plates; and a plurality of finger assemblies, at least one of the plurality of finger assemblies being pivotally attached to the plurality of substantially parallel plates and being located in the space between each of the plurality of substantially parallel plates, each of the plurality of finger assemblies having a body and an arc runner, the arc runner of at least one of the plurality of finger assemblies being advanced with respect to arc runners of other different finger assemblies of the plurality of finger assemblies.

13. The contact arm assembly of claim 12, wherein the arc runners of centrally located finger assemblies are advanced relative to finger assemblies located at the ends of the contact arm assembly.

14. The contact arm assembly of claim 12 wherein:

an arc runner interface surface of the body includes at least two orthogonally spaced apart recesses; and a body interface surface of the arc runner includes at least two orthogonally spaced apart protrusions corresponding to the at least two orthogonally spaced apart recesses, the at least two orthogonally spaced apart protrusions being configured to engage the at least two orthogonally spaced apart recesses for minimizing relative movement between the body and arc runner.

15. The contact arm assembly of claim 12, wherein the plurality of substantially parallel plates are affixed to a cage bracket, the cage bracket having a substantially flat surface and two extensions forming extension plates extending therefrom, the extension plates being substantially parallel to each other and to the plurality of substantially parallel plates, the cage bracket and extension plates substantially forming a U-shape.

16. The contact arm assembly of claim 15, wherein the cage bracket and plurality of substantially parallel plates interface with each other such that the cage bracket holds the plurality of substantially parallel plates in a substantially parallel relationship.

17. The contact arm assembly of claim 15, further comprising an end plate coupled on either side of the cage bracket, the end plates being spaced apart from and substantially parallel to the extension plates, wherein a finger assembly is located in a space between each of the end plates and the cage bracket.

* * * * *